US005915160A

United States Patent [19]

Krotz et al.

[11] Patent Number: 5,915,160

[45] Date of Patent: Jun. 22, 1999

[54] HIGH STRENGTH GOLD WIRE FOR MICROELECTRONICS MINIATURIZATION AND METHOD OF MAKING THE SAME

[75] Inventors: Phillip D. Krotz, Robins; David D. Hillman, Cedar Rapids; Nicole L. DeBlieck Cavanah, Marion, all of Iowa

[73] Assignee: Rockwell International, Costa Mesa, Calif.

[21] Appl. No.: 09/025,067

[22] Filed: Feb. 17, 1998

[51] Int. Cl.[6] ..... B22F 3/14; B22F 3/16; B22F 3/24; C22C 5/02

[52] U.S. Cl. ..... 419/20; 419/28; 419/38; 419/49; 419/3

[58] Field of Search ..... 75/247; 420/507, 420/511; 419/20, 28, 38, 49, 3

[56] References Cited

U.S. PATENT DOCUMENTS

| | | | |
|---|---|---|---|
| 3,184,835 | 5/1965 | Coxe et al. | 29/182.5 |
| 3,696,502 | 10/1972 | Darling | 29/527.7 |
| 3,779,714 | 12/1973 | Nadkarni et al. | 29/182.5 |
| 3,960,777 | 6/1976 | Coyle | 252/514 |
| 4,004,057 | 1/1977 | Hoffman et al. | 428/209 |
| 5,073,409 | 12/1991 | Anderson et al. | 427/217 |
| 5,368,657 | 11/1994 | Anderson et al. | 148/400 |
| 5,429,670 | 7/1995 | Miyoshi | 106/1.18 |

OTHER PUBLICATIONS

Toshinori Ogashiwa, Takatoehi Arikawa and Akihisa Inoue, Development of Reflowable Sn–Pb Alloy Bump for Al Pad, 1997 Electronic Components and Technology Conference, pp. 664–669.

Of Material Interest–Au–Ti Wire Strengthens At Room Temperature, Advanced Materials & Process, p. 4 (Date unknown).

Heiner Lichtenberger, Gabriel Toea & Micheal Zasowski, Development of Low Loop, Long Length, Hydrostatically Extruded Bonding Wire, 199? International Symposium On Advanced Packaging Materials, pp.120–123 (Date unknown).

*Primary Examiner*—Daniel J. Jenkins

*Attorney, Agent, or Firm*—Kyle Eppele; James P. O'Shaughnessy

[57] ABSTRACT

High strength gold wire for use in microelectronics and a method of producing the same are disclosed. In the methods of the present invention, a gold alloy having gold and a dilute rare earth (RE) element is produced. Next, the gold alloy is atomized into a powder. The dilute RE element is at least partially oxidized during atomization. Then, the powder is consolidated into an oxide dispersion strengthened gold billet. Finally, gold wire is formed from the oxide dispersion strengthened gold billet. The high strength gold wire can be drawn to a diameter less than conventional gold wire, while still maintaining mechanical and electrical properties, thereby facilitating microelectronics miniaturization.

20 Claims, 3 Drawing Sheets

HIGH STRENGTH GOLD WIRE FOR MICROELECTRONICS MINIATURIZATION AND METHOD OF MAKING THE SAME

FIELD OF THE INVENTION

The present invention relates to gold alloy wire for microelectronic circuitry. More particularly, the present invention relates to methods of producing high strength and high conductivity gold wire for microelectronics interconnects.

BACKGROUND OF THE INVENTION

Gold alloy wires currently used in microelectronics have limited electrical and mechanical properties due to elemental alloy addition limitations. Reduction in size of microelectronic designs is constrained by a narrow range of pad and die geometries because of these alloy property limitations. For example, wire currently available for use in microelectronics is limited to a wire bondable length of 100 times the diameter of the wire. Lengths greater than 100 times the diameter of the wire will result in the wire slumping under its own weight, which is a result of the low strength of the material used to produce the wire. As a result, wire thicknesses cannot currently be reduced without simultaneously reducing the maximum bondable length of the wire. Conversely, the maximum bondable length of the wire cannot be increased without increasing the wire thickness.

Consequently, a gold alloy wire having sufficient strength to allow a wire diameter reduction from the commercially available thicknesses (0.00100–0.00125 inches) while maintaining currently achievable bondable wire lengths would be a significant improvement in the art.

SUMMARY OF THE INVENTION

High strength gold wire for use in microelectronics and methods of producing the same are disclosed. In the methods of the present invention, a gold alloy having gold and a dilute rare earth (RE) element is produced. Next, the gold alloy is atomized into a powder. The dilute RE element is at least partially oxidized during atomization. One optional method to promote complete oxidation of the RE element in the Au—RE alloy powder is to blend the alloy powder with a second powder of a transition metal (TM) oxide, like silver oxide, which can be reduced easily. Then, the powder is warm or hot consolidated into an oxide dispersion strengthened gold billet. Optionally, during the hot consolidation the second powder of TM oxide is reduced by the RE element to form additional RE oxide dispersion hardening particles, leaving pure TM which would dissolve in the gold phase and have minimal impact on the electrical conductivity. Finally, gold wire is formed from the oxide dispersion strengthened gold billet. The high strength gold wire can be drawn to a diameter less than conventional gold wire, while still maintaining mechanical and electrical properties, thereby facilitating microelectronics miniaturization.

BRIEF DESCRIPTION OF THE DRAWINGS

The invention may be more fully understood by reading the following description of a preferred embodiment of the invention in conjunction with appended drawings wherein.

DETAILED DESCRIPTION OF THE PREFERRED EMBODIMENTS

The present invention includes methods of producing gold alloy wire (hereafter "gold wire"), using powder metallurgy techniques, which is stronger than commercially available gold wire. The higher strength gold wire can be used for microelectronics interconnects at lengths of greater than 100 times the diameter of the wire. When produced at a diameter of 0.001 inches (i.e., the diameter of currently commercially available gold wire), the gold wire of the present invention can be used in lengths longer than currently possible with commercially available gold wire having the same thickness. In the alternative, the gold wire of the present invention can be produced at a reduced thickness while maintaining the same maximum wire bondable length possible with the thicker commercially available gold wire. This reduction in thickness will facilitate microelectronic miniaturization and the development of smaller and lighter weight electronic devices and greater design flexibility.

Figure 1:
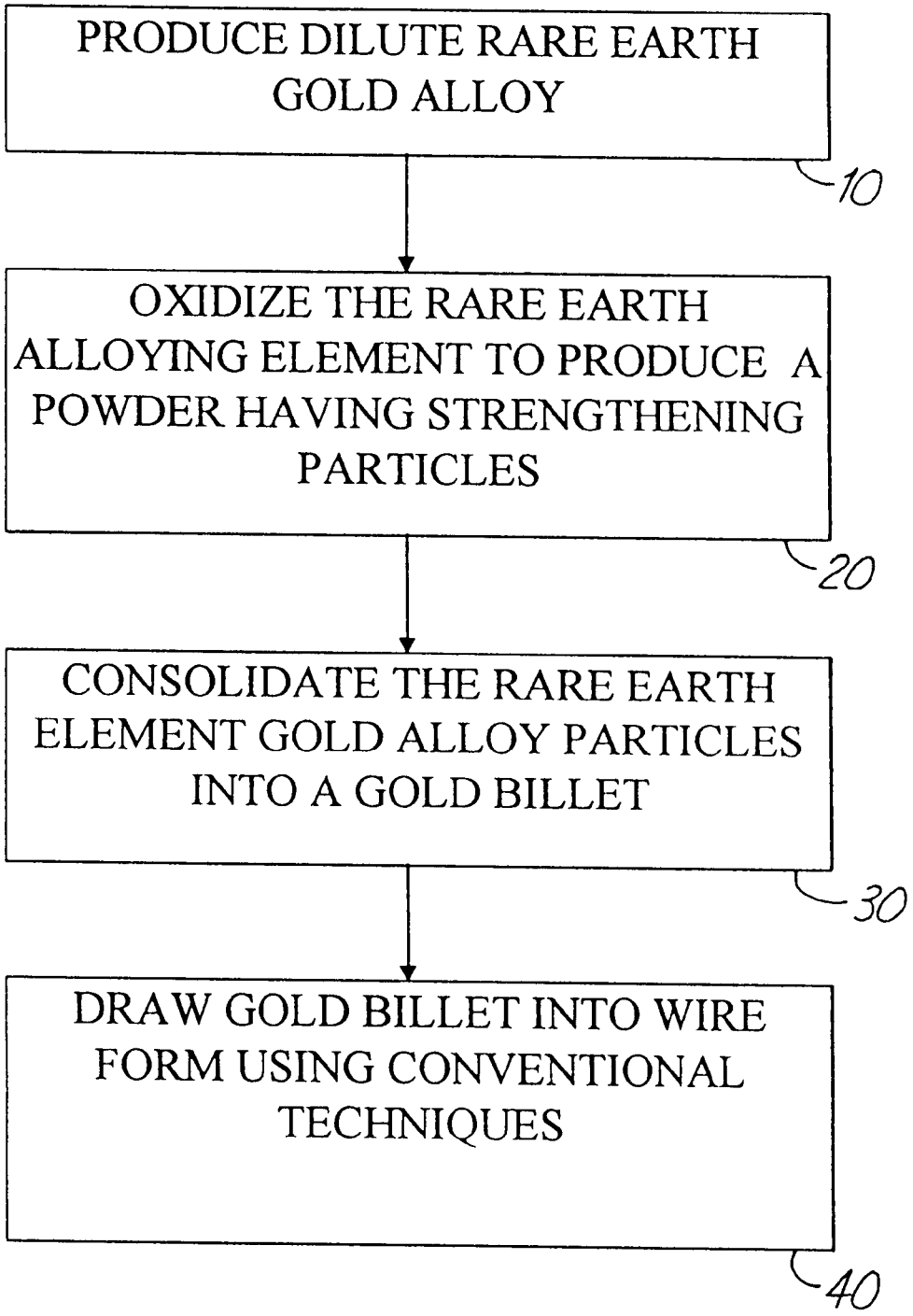
FIG. 1 is a block diagram of a preferred method of producing high strength gold alloy wire in accordance with the present invention.
Figure 2:
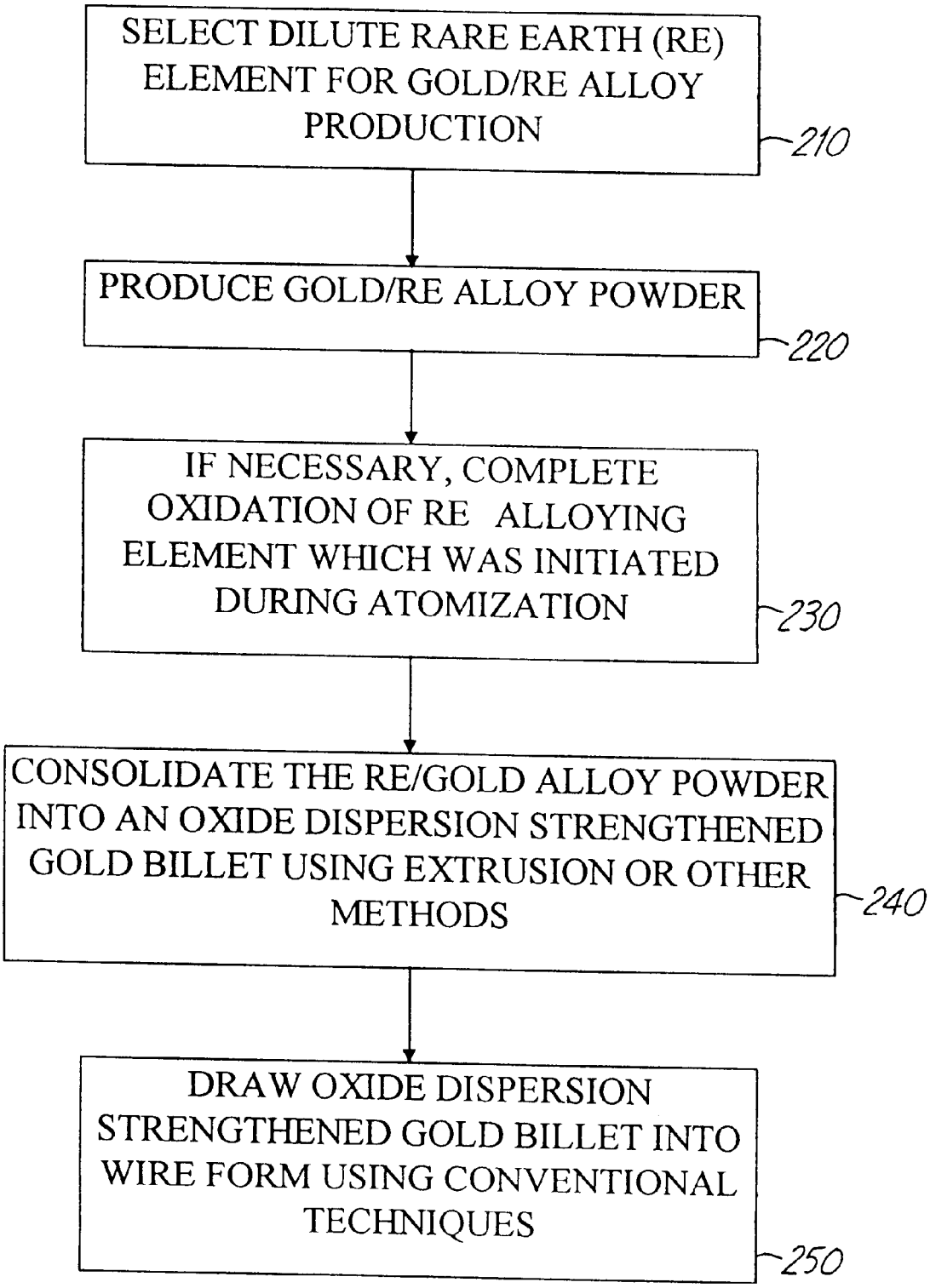
FIG. 2 is a flow diagram illustrating in greater detail the preferred method of producing high strength gold alloy wire of the present invention.

FIG. 1 is a flow diagram which illustrates generally methods of producing gold wire in accordance with preferred embodiments of the present invention. FIG. 2 provides a more detailed illustration of the methods of the present invention.

As illustrated in FIG. 1 at box 10, the methods of the present invention begin with production of dilute rare earth (RE) gold alloy (e.g., Au—Y, Au—Ce, etc.). A lower cost alternative to the use of a pure RE element addition would be a RE "mischmetal" (Mm), which is an alloy of several RE elements. As used herein, RE element is intended to include RE alloys such as RE Mm. Dilute RE alloy additions are preferred because of their high oxidation tendency, but other metallic elements may also be used if their oxidation tendency is also high and they are capable of very dilute solid solution in gold.

Next, as illustrated at box 20, the RE alloying element is oxidized to produce a powder having strengthening oxidized RE particles. Next, as illustrated at box 30, the powder containing the oxide dispersion strengthened RE particles and gold particles are consolidated into a gold billet. The gold billet is oxide dispersion strengthened. Finally, as illustrated at block 40, the oxide dispersion strengthened gold billet is drawn into gold wire using conventional wire drawing techniques.

FIG. 2 provides a more detailed illustration of preferred methods of the present invention. As illustrated at block 210, fabrication of the oxide dispersion strengthened gold wire of the present invention begins with selection of a dilute RE element for use in forming the RE/gold alloy. RE elements have a great affinity for oxygen and are therefore good candidates for the gold alloys of the present invention. RE elements create stable RE oxide particles and have low solid solubility in gold. In preferred embodiments of the present invention, Yttrium or Cerium can be used for the dilute RE element. Each of these RE element candidates has a minimal impact on electrical conductivity of the gold.

As illustrated in step 220, selection of the dilute RE element is followed by production of the RE/gold alloy powder. The alloy can be prepared using conventional melting techniques such as induction melting. It is contemplated that the alloy should include between approximately 0.1 percent and approximately 10 percent by weight of the RE element. Next, the melt is atomized to produce a powder.

Atomization of the melt is preferably accomplished using gas atomization in an inert gas/oxygen mixture. However, the gas atomization can also occur solely in an inert gas, or solely in oxygen. Further, centrifugal atomization or other atomization methods can be used to atomize the melt instead of using gas atomization.

Next, as illustrated in block 230, if oxidation of the RE alloying element was not completed by the oxidizing reaction initiated during atomization, an oxide dispersion reaction can be initiated to substantially complete oxidation of the RE particles. This oxidation can be accomplished by exposing the powder to a partial atmosphere of oxygen at an elevated temperature. The time required for this preferred method of initiating the oxide dispersion reaction is temperature/diffusion rate dependent. It may be preferred to discourage sintering of the particles during this oxidation treatment by tumbling the powder in a rotating kiln device. An alternative to the above described oxidation method is to ball mill the powder with hard steel or other balls or rods in an oxidizing atmosphere to refine and oxidize the RE containing particles. Another optional method of promoting complete oxidation of the RE element in the Au—RE alloy powder is to blend the alloy powder with a second powder of a transition metal (TM) oxide, like silver oxide, which can be reduced easily.

Next, as illustrated at block 240, the powder containing the oxidized RE element and the gold is consolidated into an oxide dispersion strengthened gold billet using a can and extrude process to form a bar or a rod. While can and extrude processes are preferred, the powder consolidation can also be achieved using a hot isostatic press (HIP) method or a cold isostatic press (CIP) method. Finally, as illustrated at block 250, the oxide dispersion strengthened gold billet is drawn into a wire form using conventional techniques. If a second powder of TM oxide was used to complete oxidation, during the hot consolidation the second powder of TM oxide is reduced by the RE element to form additional RE oxide dispersion hardening particles, leaving pure TM which would dissolve in the gold phase.

The steps illustrated in blocks 230 and 240 are critical to the creation and development of a dilute, small oxide particle dispersion to increase strength (room and elevated temperature) by pinning grain boundaries of the gold alloy and not greatly impacting electrical conductivity. As mentioned above, the increased strength of the oxide dispersion strengthened gold should allow a reduction in the size of the microelectronic bond wires produced from the currently commercially available 0.001 inches to a reduced thickness of 0.0007 inches or less. At the same time, the maximum bondable wire length associated with the prior art wire should be maintained, thus facilitating microelectronic miniaturization without introducing length related design limitations.

Figure 3:
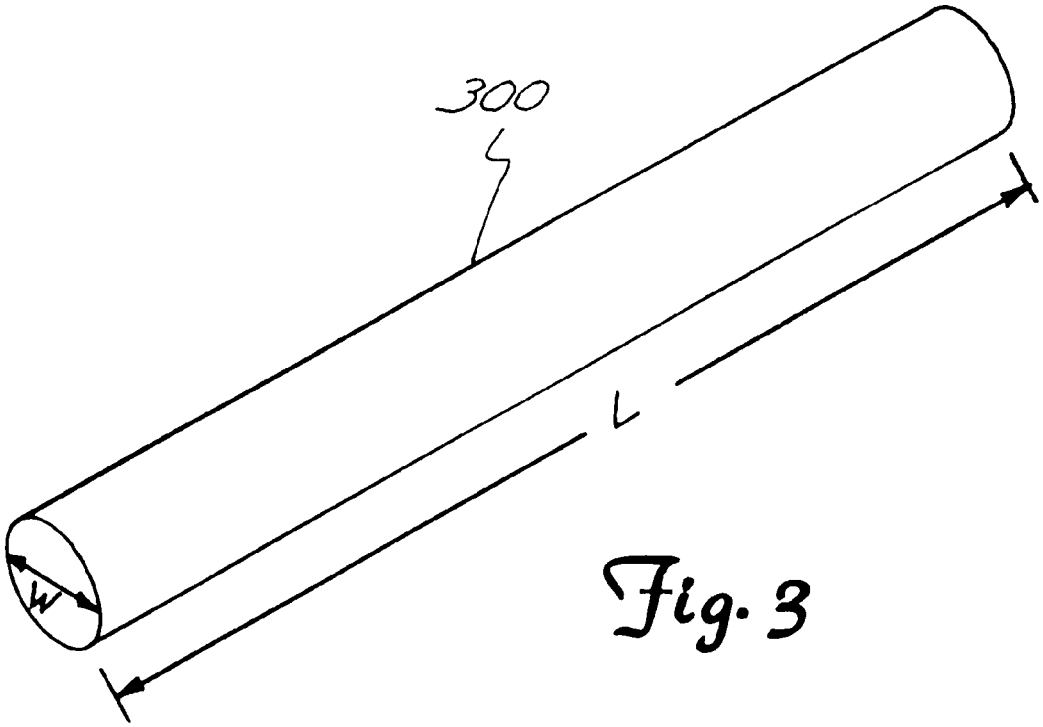
FIG. 3 is a diagrammatic illustration of high strength gold alloy wire in accordance with the present invention.

FIG. 3 is a diagrammatic illustration of gold wire 300 fabricated using the preferred methods of the present invention. The oxide dispersion strengthening provided by the oxidized RE particles allows gold wire to be produced and used in microelectronic wire bonding at lengths and widths which satisfy the relationship $$L>W*100$$

where,

W the width or thickness of the gold wire; and

L=the maximum bondable length of the gold wire which will not result in the wire slumping under its own weight.

Although the present invention has been described with reference to preferred embodiments, workers skilled in the art will recognize that changes may be made in form and detail without departing from the spirit and scope of the invention.

What is claimed is:

1. A method of producing gold wire comprising: producing an alloy having a dilute rare earth (RE) element and gold;

changing the alloy into a powder having the RE element in an at least partially oxidized form and having the gold;

forming a billet from the powder; and forming wire from the billet.

2. The method of claim 1, wherein producing an alloy having a dilute RE element includes producing an alloy having Yttrium.

3. The method of claim 1, wherein producing an alloy having a dilute RE element includes producing an alloy having Cerium.

4. The method of claim 1, wherein producing an alloy having a dilute RE element and gold includes producing an alloy which has between about 0.1 percent and about 10 percent RE element by weight.

5. The method of claim 1, wherein changing the alloy into a powder having the gold and having the RE element in the at least partially oxidized form comprises atomizing the alloy, wherein atomizing the alloy least partially oxidizes the RE element.

6. The method of claim 5, and further comprising oxidizing unoxidized portions of the RE element by initiating an oxide dispersion reaction.

7. The method of claim 5, wherein forming a billet from the powder further comprises forming a billet from the powder using a can and extrude process.

8. The method of claim 5, wherein forming a billet from the powder further comprises forming a billet from the powder using a hot isostatic press process.

9. The method of claim 5, wherein forming a billet from the powder further comprises forming a billet from the powder using a cold isostatic press process.

10. The method of claim 5, wherein forming the wire from the billet further includes forming the wire such that it has a ratio of thickness W to bondable length L which satisfies the relationship L>W*100.

11. The method of claim 10, wherein forming the wire further comprises forming the wire such that it has the thickness W of no more than about 0.0009 inches.

12. A method of producing gold wire comprising:

producing a gold alloy having a dilute earth (RE) element and gold;

oxidizing the RE element in the gold alloy to produce an alloy having gold and oxidized RE particles; and forming wire from the alloy having gold and the oxidized RE particles.

13. The method of claim 12, wherein producing the gold alloy includes producing an alloy having Yttrium and gold.

14. The method of claim 12, wherein producing the gold alloy includes producing an alloy having Cerium and gold.

15. The method of claim 12, wherein producing the gold alloy further includes melting the gold and the RE element to form a melt having the RE element and the gold, wherein oxidizing the RE element in the gold alloy to produce an alloy having gold and oxidized RE particles further includes atomizing the melt to produce a powder.

16. The method of claim 15, wherein atomizing the melt further includes centrifugal atomization of the melt.

17. The method of claim 15, wherein oxidizing the RE element in the gold alloy to produce an alloy having gold and oxidized RE particles further includes initiating an oxide dispersion reaction to substantially complete oxidation of the RE particles.

18. The method of claim 15, wherein forming wire from the alloy having gold and the oxidized RE particles includes forming a billet from the powder and forming wire from the billet, wherein the wire has a thickness of less than 0.001 inches.

19. A method of producing gold wire comprising:

producing a gold alloy having gold and a dilute rare earth (RE) element;

atomizing the gold alloy into a powder, wherein the dilute RE element is at least partially oxidized during atomization;

consolidating the powder into an oxide dispersion strengthened gold billet; and forming gold wire from the oxide dispersion strengthened gold billet, wherein the gold wire has a thickness of less than 0.001 inches in diameter.

20. The method of claim 19, and after the step of atomizing the gold alloy into a powder, further comprising initiating an oxide dispersion reaction to substantially complete oxidation of the RE element in the gold alloy powder.

* * * * *

UNITED STATES PATENT AND TRADEMARK OFFICE

CERTIFICATE OF CORRECTION

PATENT NO : 5,915,160

DATED : June 22, 1999

INVENTOR(S) : Phillip D. Krotz, David D. Hillman, Nicole L. DeBlieck Cavanah, and Iver E. Anderson It is certified that error appears in the above-identified patent and that said Letters Patent are hereby corrected as shown below:

On title page, item 75 Inventors:
replace "all of Iowa"
with --Iver E. Anderson, Ames, all of Iowa--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*